United States Patent [19]

Bauer

[11] Patent Number: 4,926,781

[45] Date of Patent: May 22, 1990

[54] PORTABLE PERSONAL FLOATATION DEVICE

[76] Inventor: Martin G. Bauer, Rte. 1, Box 1, Bismarck, N. Dak. 58501

[21] Appl. No.: 234,898

[22] Filed: Aug. 22, 1988

[51] Int. Cl.[5] ..... B63C 9/10

[52] U.S. Cl. ..... 114/351; 114/283; 114/357; 440/72; 441/130

[58] Field of Search ..... 114/61, 351, 357, 283; 441/86, 129, 130, 131, 88, 119, 106; 440/71, 72

[56] References Cited

U.S. PATENT DOCUMENTS

| | | | |
|---|---|---|---|
| 299,951 | 6/1884 | Brown . | |
| 315,297 | 4/1885 | Kenly | 114/351 |
| 660,504 | 10/1900 | German | 114/351 |
| 1,053,472 | 2/1913 | Boatright | 441/130 |
| 1,567,555 | 12/1925 | Straussler . | |
| 1,657,786 | 1/1928 | Carmichael | 114/351 |
| 2,332,009 | 10/1943 | Perri . | |
| 2,674,753 | 4/1954 | Wood . | |
| 2,747,204 | 5/1956 | Erickson et al. | 114/351 |
| 2,803,837 | 8/1957 | Virobik | 114/351 |
| 2,894,270 | 7/1959 | Manthos | 441/131 |
| 2,975,749 | 3/1961 | Armstrong | 114/283 |
| 3,123,840 | 3/1964 | Cefalo, Jr. . | |
| 3,198,274 | 8/1965 | Cocksedge | 114/61 |
| 3,324,488 | 6/1967 | Schulz, Jr. . | |
| 3,471,875 | 10/1969 | Lyon . | |
| 3,477,074 | 11/1969 | Bezanis | 441/86 |
| 3,704,472 | 12/1972 | Huey | 114/351 |
| 3,732,587 | 5/1973 | Fletcher | 114/357 |
| 3,955,230 | 5/1976 | Rogers et al. | 441/131 |
| 4,315,475 | 2/1982 | Echols . | |

*Primary Examiner*—Sherman D. Basinger
*Assistant Examiner*—Thomas J. Brahan
*Attorney, Agent, or Firm*—Kinney & Lange

[57] ABSTRACT

A portable personal floatation device for water sports such as fishing and the like is constructed of a light material such as styrofoam and has a horizontal main panel with an opening for a user to fit through so the floatation device surrounds the user. The device is designed to be easily accessible for the user, with a door provided on a side panel. The central opening in the main panel of the device accommodates the occupant to carry the device and wade into the water, and as the device begins to float, the occupant may sit on the main panel of the device.

11 Claims, 2 Drawing Sheets

PORTABLE PERSONAL FLOATATION DEVICE

BACKGROUND OF THE INVENTION

1. Field of the Invention

This invention pertains to a portable personal floatation device for recreational water sports such as fishing and the like.

2. Description of the Prior Art

An assortment of portable watercraft have been introduced in the prior art to provide recreational vehicles for sportsmen. Several variations on an innertube float or toroidial buoy have been disclosed in U.S. Pat. Nos. 2,674,753; 3,123,840; and 3,324,488. U.S. Pat. No. 2,674,753 shows a manually operated boat with a floatation ring designed to carry a single occupant with legs extending through the bottom of the boat for propelling the craft through the water. However, this device does not permit easy access into the boat, or a means to exit from the boat while in the water. This patent does not provide a mount for a small motor, either.

Another floatation device using a ring around the occupant's body is presented in U.S. Pat. No. 3,324,488. This device also does not provide a door or easy access to the opening through the boat. In much the same way, the Cefalo, Jr. U.S. Pat. No. 3,123,840 discloses a portable collapsable one-person boat employing an innertube-shaped buoy which can be attached to a motor. All three of these portable boats with innertube floatation systems are not designed to be easily accessible.

Lyon U.S. Pat. No. 3,471,875 shows a portable fishing float with a rectangular hull and an adjustable chair. While this device is adapted to be portable, it is not designed to allow the user to carry the boat into the water while in it. This device is not adapted for use with the motor, and is not easily accessible in deep water.

U.S. Pat. No. 2,332,009 granted to Perri shows a float having a frame with hinged sides and two inflatable pontoons. While this device is designed to be collapsed when not in use, it is not constructed to allow the user to walk into the water with the boat around the user, and is not easily accessible in shallow water.

A catamaran is disclosed in Echols U.S. Pat. No. 4,315,475. It is collapsible, and adaptable to be used with a motor. This design shows a chair suspended above two pontoon floats, as opposed to a device which can be used while wading. The catamaran is not accessible by a door, and can not be carried about the user while walking into the water.

Another type of watercraft using floats, and designed to be operated by one person is disclosed in U.S. Pat. No. 1,567,555. This device is used for swimming, and is not adapted to be used for fishing, which requires a sturdier frame to leave the occupant free for sports.

A hammock canoe is shown in Brown U.S. Pat. No. 299,951. This boat has a central opening to allow the occupant to walk into the water and begin floating once the boat and user have reached deep water. This device is not designed, however, to allow easy access by door, and is not adapted for the use of a motor, or for sports which require a sturdy frame and easy control of the craft.

None of the devices show an easily accessible floatation device that is portable and yet designed to be sturdy enough to allow sportsmen to have free use of their hands. While some of the devices in the prior art are portable, they do not show a device that can be easily used both for wading and in deep water.

SUMMARY OF THE INVENTION

A portable personal floatation device has a pair of pontoon-like side floats joined together with a main panel which has a central opening in which a user can stand. A door is provided in one of the two side pontoon panels for easy access. The main panel of the frame accommodates the occupant in the central opening. The pontoons extend from the center panel downwardly to support the center panel approximately slightly above the water level when supporting the weight of the occupant. The occupant carries the device into the water while standing in the opening. When the device is floating on the water, the user sits on the center panel with legs extending into the water through the opening. When the occupant would like to exit the floatation device, for example when the water is waist deep, the door provides an easy egress (or access) instead of jumping over the side of the float which can be difficult and dangerous.

The frame is adapted to allow an outboard motor to be attached. The side pontoon panels have integrally mounted handles to allow the user to lift and hold the boat while wading into the water. The relatively light weight of the device, approximately in the range of 35 to 40 pounds, allows the user to carry the device easily while it is in place around the waist.

Safety straps are removably connected across the opening defined by the first panel, and are preferably positioned between the user's legs to stop the user from falling all of the way through into the water in case of an accidental slip into a deep hole while wading. While the safety straps do not constrict movement while the user has their feet through the center opening, to wade or paddle the boat, they are adapted to provide a reliable means of stopping the occupant from falling all the way through the center opening.

The door for accessing the opening defined in the main panel has a latch for securing the door in a closed position. A bar is supported between the side pontoons in front of the opening in the main panel. Also, a protective screen may be stretched between the side panels and extends downwardly from the first panel to the footrest bar. This protective screen is to keep the user's feet from contact with the motor or propeller if such is used.

Adjustable stand-in footrests hang below the boat into the water. At least one footrest hangs by rope fasteners of suitable length, and the ropes are attached to the first main panel of the floatation device. The use of adjustable ropes for the footrest allows the user to adapt the length of the rope for comfort.

The main support panel and the side pontoon panels of the personal floatation device are preferably constructed from a buoyant material, such as styrofoam, to create a light yet durable watercraft.

DETAILED DESCRIPTION OF THE PREFERRED EMBODIMENTS

Figure 1:
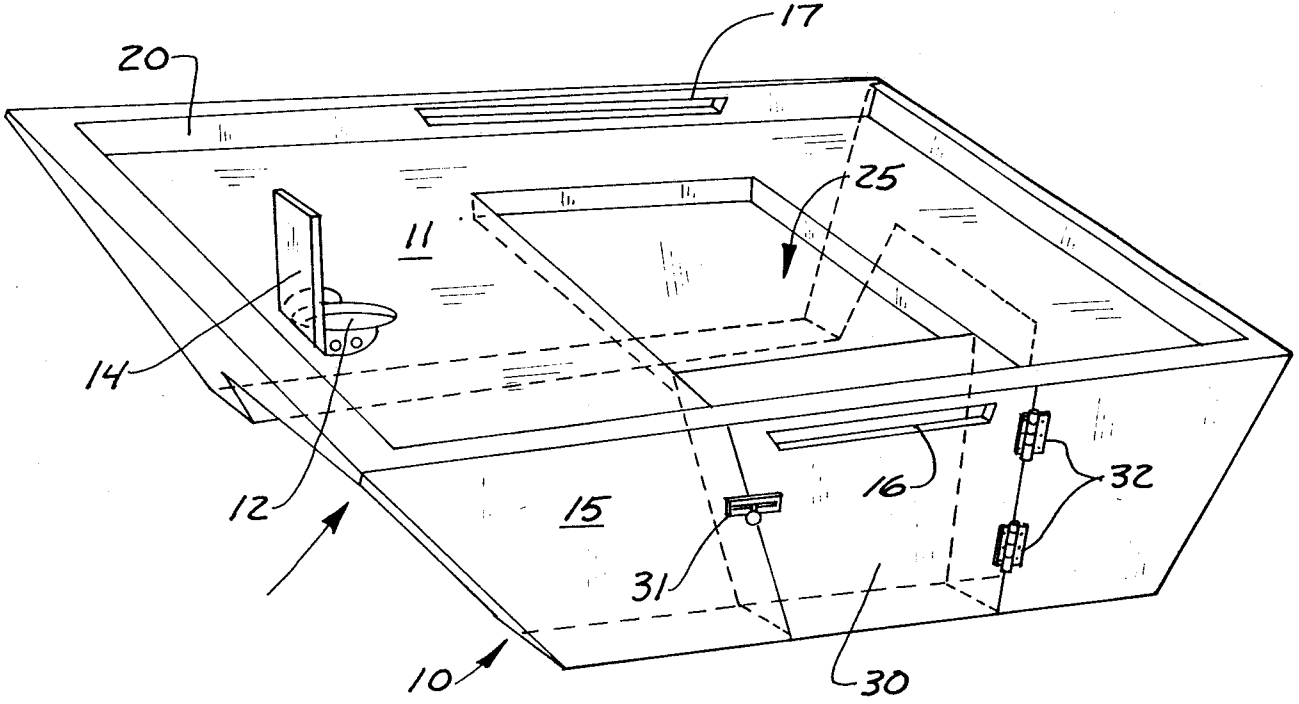
FIG. 1 is a perspective view of a portable personal floatation device made according to the present invention.

As shown in the drawings, at FIG. 1, a portable personal floatation device indicated generally at 10 comprises a frame including a first main generally horizontal panel 11 and vertical side panels 15 and 20 which are in the form of relatively wide pontoons that extend below the main panel and which are spaced apart to form a central channel 24 between them. The first main panel 11 has a central opening shown generally at 25, which is of the size to accommodate a user.

As seen in FIG. 1, the side panel 15 has a door 30 cut therein which is mounted on hinges 32 on one edge so that it can swing open, and permit the user to easily step into the opening 25 when the device is to be used. The door swings out from the side panel 15 and can be secured in a closed position by a latch 31. The side panels have narrow upper rims 15A and 20A and a handle 16 is formed in the rim above panel 15 and side panel 20 has a handle 17. These handles 16 and 17 are to carry the personal floation device 10 while the user stands in the opening 25 and wades into the water.

The personal floation device 10 is to be lifted by the handles 16 and 17 while the user is standing in the opening 25, allowing the person in the opening to walk into the water with the float around them for easy portage. While the user is carrying the float, the door 30 must be closed. Once the device is in the water and floating, the user can be seated on the main panel 11 with the user's legs extending into the water. If the user wishes to get out of the floatation device, without carrying it onto shore, the door 30 provides an easy egress (or access) from the opening 25. The door 30 is designed to fit snugly into the side panel 20 to form a continuous panel for the side of the float. The central channel 24 between side panels 20 and 15 accommodates the user who is standing in the opening 25.

Figure 3:
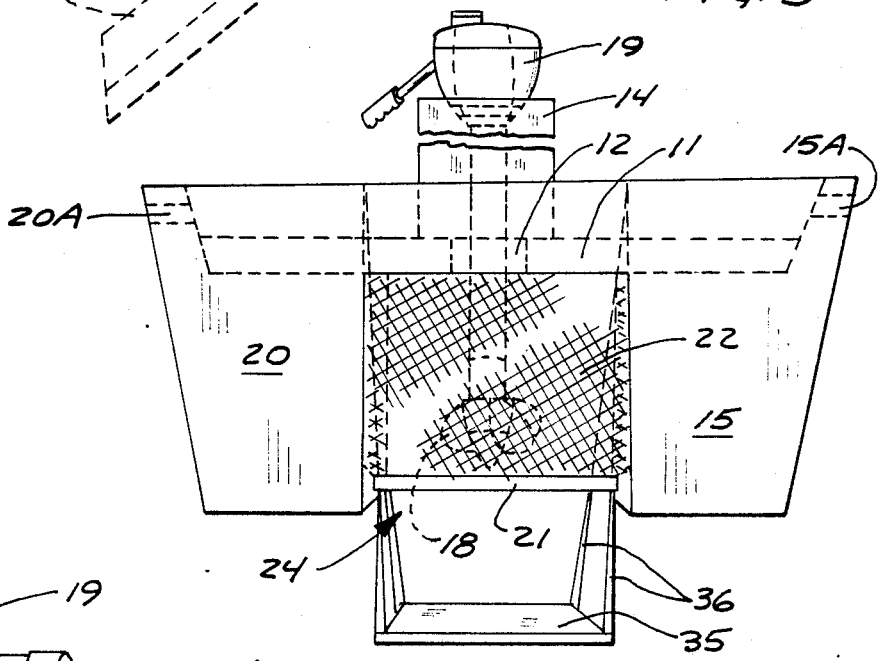
FIG. 3 is a front elevational view of the device of FIG. 1.
Figure 4:
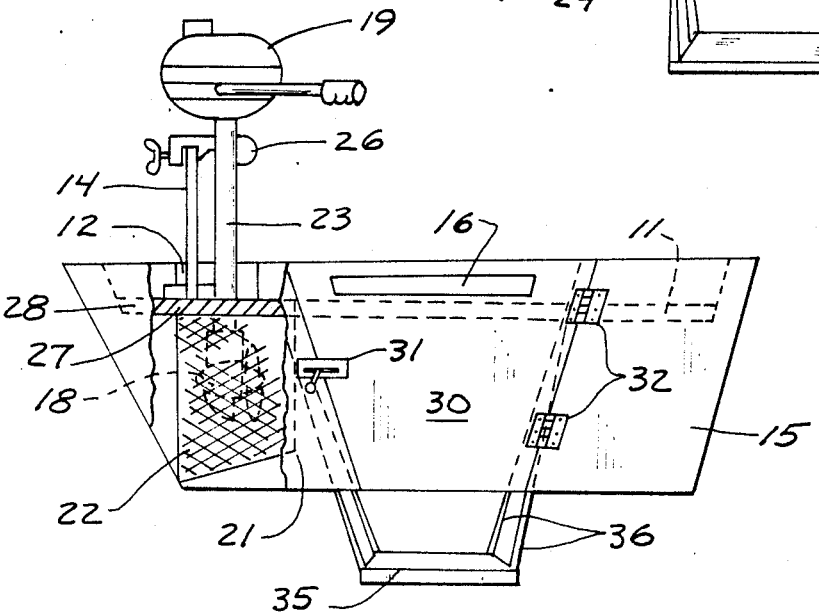
FIG. 4 is a side elevational view with a cutaway view of the device of FIG. 1.

The personal floatation device is adapted to be used with a small outboard motor 19, which has a motor shaft 23 and propeller 18. As best seen in FIGS. 3 and 4, a support board 14 is fixed to panel 11 adjacent a hole 12. The hole 12 accommodates the motor shaft 23 while the support board 14 supports the motor 19 using a clamp 26 to hold the motor fixed to the support board 14. The motor shaft 23 and propeller 18 extend below the main panel 11 and into the channel 24 ahead of the user.

A protective screen 22 is stretched between side panels 15 and 20 and supported thereon between the propeller 18 and the user's feet to protect the user's feet from the propeller. A footrest bar 21 is supported between the side panels 15 and 20 and extends across central channel 24 to provide a lower support for the protective screen 22 as well as a footrest. The protective screen 22 extends between the footrest bar 21 and the main panel of the personal floatation device 10. This protective screen 22 is thus supported between the user in opening 25 and the propeller 18, to protect the user from the propeller if a motor is used on the floatation device.

Figure 2:
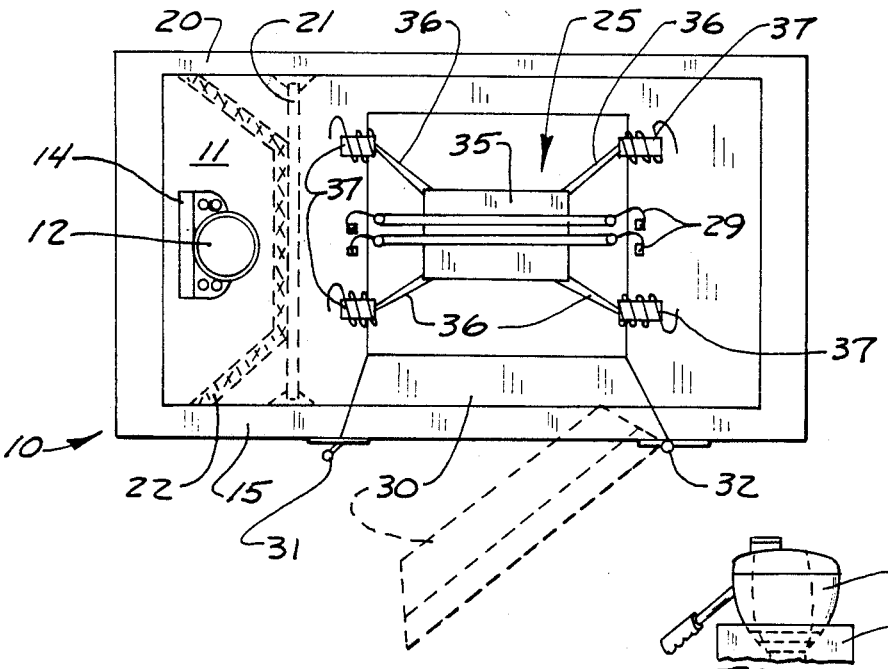
FIG. 2 is a top plan view of the device of FIG. 1.

In FIG. 2, safety straps 29 are shown. These safety straps 29 are removably connected with hooks across the opening 25 and are positioned to be between the legs of a user. These safety straps are to assure that the user in the opening 25 does not slide through inadvertently while seated on the main panel 11. If the user suddenly enters deeper water while seated on the main panel 11 and slides off the seat, the safety straps 29 will stop the user from sliding all the way through the central opening 25 which could be dangerous.

Referring to FIG. 3, a hanging footrest 35 hangs below the main body of the personal floatation device 10 and is connected to main panel 11 by ropes 36. This footrest 35 can be moved to the side when the user is walking with the floatation device 10 around the waist of the user. This hanging footrest 35 is to be used when the personal floatation device is floating in deeper water and the user is seated on the panel 11. The hanging footrest is adjustably attached to the main panel of the personal floatation device by ropes 36 which are attached on rope cleats 37. Because the hanging footrest is adjustable, the user can adjust the ropes to hold the footrest at a comfortable level. The rope cleats 37 are designed so the ropes can be easily tightened or loosened and are adjusted like other nautical rope cleats. The footrest bar 21 provides an alternate footrest from the adjustable footrest 35.

The personal floatation device 10 is constructed from a buoyant material such as styrofoam (foamed polystyrene). As best seen in FIG. 4 at the cutaway view, the styrofoam core 28 is surrounded by an aluminum skin 27 to provide a durable yet lightweight personal floatation device. Adhesives can be used for joining the components together.

While this embodiment has shown a motor 19 to be used to propel the personal floatation device, a sail or oars can be used just as easily. The sail mast can be supported at opening 12 on a suitable support, such as support 14. When sailing the footrest 35 would be adjusted to be deep and the footrest and the legs of the person act as a daggerboard or "keel" for sailing.

Also, the footrest can be designed to have foot paddles for propulsion if desired.

The main panel 11 can have inflated tubes or pontoons as means along the sides to provide floatation. The panel 11 will provide a place for a person to sit, and an access door can be provided if desired. A portion of the panel 11 can form the door, and the inflated pontoon could be compartmented or sectioned to form the door as well.

Although the present invention has been described with reference to preferred embodiments, workers skilled in the art will recognize that changes may be made in form and detail without departing from the spirit and scope of the invention.

What is claimed is:

1. A portable personal flotation device comprising:

a support frame having a main horizontal panel with side panels comprising elongated, longitudinally extending buoyant pontoons attached to the main panel along the sides thereof and extending downwardly from the main panel, the pontoons having front and rear ends and being spaced apart;

an opening in the main panel of use to permit a person to extend through, said opening being defined by the side panels along the sides thereof;

a door formed in a portion of one pontoon, and the door defining one side of the opening in the main panel, the door extending between a top and bottom of the one pontoon and being positioned between the front and rear ends thereof; and the main panel having sufficient space for the person to sit thereon with legs through the opening.

2. The device as specified in claim 1 wherein the support frame includes means for supporting an outboard motor adjacent a forward end of the floatation device and within the perimeter of the personal floatation device.

3. The device as specified in claim 1 and a protective screen mounted between the side panels and extending downwardly from the first panel to the rear of the means for supporting an outboard motor.

4. The device as specified in claim 1 and a footrest bar supported between the side panels in position to be normally forward of the opening.

5. The device as specified in claim 1 and an adjustable stand-in footrest comprising:

a plurality of rope fasteners of suitable length;

attachment means on the support frame for the rope fasteners; and at least one footrest panel hanging downwardly from the support frame below the central opening, and supported generally horizontally on a plurality of rope fasteners extending through the opening.

6. The device as specified in claim 1 wherein the main panel and the side panels are formed of a foamed polystyrene.

7. A portable personal floatation device comprising:

a pair of pontoon members made of a plastic foam material having a longitudinal length and having front and rear ends, said pontoon members being spaced apart and substantially aligning in transverse direction;

a main support member joining the pontoon members at front and rear ends thereof, said main support member comprising a panel defining a horizontal surface, and having front and rear portions defining an opening between the pontoon members and between the front and rear portions, said opening being of size to permit a person to be positioned therein;

a door on one of said pontoon members defining a side of said opening, said door including an entire section of the pontoon hingedly mounted for permitting pivoting of said section outwardly so that a person to use the floatation device can gain access to the opening; and said door having inwardly tapered side edges to permit the door to be swung open from one edge thereof, and hinge means to fasten said one edge to the rest of said one pontoon.

8. The personal floatation device of claim 7, and a second opening in a forward portion of said panel of size to permit a drive unit of an outboard motor to extend from the top surface of the panel downwardly, whereby the drive unit will be in water in which the personal floatation device is used, and a support for holding said outboard motor in position with the drive unit extending below the front panel portion, and a safety screen positioned at a location between the drive unit and the second opening so that a person in the first mentioned opening is shielded from the drive unit.

9. The personal floatation device of claim 7 and footrest means for supporting the feet of a user in the opening, the rear portion of said panel being of size so that a user can sit thereon with the feet on the footrest means.

10. A portable personal flotation device comprising:

a support frame having a main horizontal panel with side panels comprising elongated, longitudinally extending buoyant pontoons attached to the main panel along the sides thereof and extending downwardly from the main panel, the pontoons having front and rear ends and being spaced apart;

an opening in the main panel of use to permit a person to extend through, said opening being defined by the side panels along the sides thereof;

the main panel having sufficient space for the person to sit thereon with legs through the opening; and the side panels extending upwardly from the main panel, and wherein elongated fore and aft extending slots forming handles are provided on the side panels above the main panel.

11. The device of claim 10 wherein the side means comprise foamed plastic material forming pontoons having exterior surfaces.

* * * * *

UNITED STATES PATENT AND TRADEMARK OFFICE

CERTIFICATE OF CORRECTION

PATENT NO. : 4,926,781

DATED : May 22, 1990

INVENTOR(S) : Martin G. Bauer

It is certified that error appears in the above-identified patent and that said Letters Patent is hereby corrected as shown below:

Col. 5, line 4, delete "claim 1", insert --claim 2--.

Signed and Sealed this

Twenty-first Day of April, 1992

*Attest:*

HARRY F. MANBECK, JR.

*Attesting Officer*

*Commissioner of Patents and Trademarks*